US008350483B2

(12) United States Patent
Arai

(10) Patent No.: US 8,350,483 B2
(45) Date of Patent: Jan. 8, 2013

(54) LIGHT-EMITTING ELEMENT DRIVING CIRCUIT

(75) Inventor: Takeshi Arai, Isesaki (JP)

(73) Assignees: Sanyo Semiconductor Co., Ltd., Gunma (JP); Semiconductor Components Industries, LLC, Phoenix, AZ (US)

( * ) Notice: Subject to any disclaimer, the term of this patent is extended or adjusted under 35 U.S.C. 154(b) by 316 days.

(21) Appl. No.: 12/639,704

(22) Filed: Dec. 16, 2009

(65) Prior Publication Data

US 2010/0156317 A1 Jun. 24, 2010

(30) Foreign Application Priority Data

Dec. 18, 2008 (JP) ..... 2008-322741

(51) Int. Cl.
*G09G 3/10* (2006.01)
*G09G 5/00* (2006.01)

(52) U.S. Cl. ..... 315/169.2; 315/169.3; 315/307; 345/84; 345/204

(58) Field of Classification Search .... 315/169.1–169.4, 315/291, 294, 295, 299, 307, 308, 312; 345/48, 345/55, 76–80, 84, 98, 100, 102, 204, 208, 345/211–214, 690
See application file for complete search history.

(56) References Cited

U.S. PATENT DOCUMENTS 6,995,516 B2 * 2/2006 Aoki et al. ..... 315/169.3
7,446,779 B2 * 11/2008 Ikeda et al. ..... 345/589
7,468,639 B2 * 12/2008 Murayama et al. ..... 332/109
7,995,020 B2 * 8/2011 Yamazaki et al. ..... 345/89
2003/0016198 A1 * 1/2003 Nagai et al. ..... 345/83
2003/0107542 A1 * 6/2003 Abe et al. ..... 345/89
2006/0033443 A1 2/2006 Ishii et al.

FOREIGN PATENT DOCUMENTS

JP 2003-158300 A 5/2003
KR 20060050356 A 5/2006

OTHER PUBLICATIONS

Patent Abstracts of Japan for Japanese Publication No. 2003-158300, publication date May 30, 2003 (1 page).
Office Action for Korean Patent Application No. 2009-126100 mailed Jun. 20, 2011, with English translation thereof (6 pages).

* cited by examiner

*Primary Examiner* — Jimmy Vu
(74) *Attorney, Agent, or Firm* — Osha Liang LLP

(57) ABSTRACT

A light-emitting element driving circuit includes a PWM signal output circuit configured to output a plurality of PWM signals each having one logic level whose duty ratio corresponds to gradation data and each corresponding to each of a plurality of light-emitting elements, on the basis of the gradation data indicating brightness of each of the plurality of light-emitting elements. A driving signal output circuit is configured to change the duty ratio of each of the plurality of inputted PWM signals to output the plurality of changed PWM signals as a plurality of driving signals, on the basis of instruction data for changing the brightness of the plurality of light-emitting elements. A driving circuit is configured to drive the plurality of light-emitting elements on the basis of a duty ratio of each of the plurality of driving signals.

3 Claims, 5 Drawing Sheets

LIGHT-EMITTING ELEMENT DRIVING CIRCUIT

CROSS-REFERENCE TO RELATED APPLICATION

This application claims the benefit of priority to Japanese Patent Application No. 2008-322741, filed Dec. 18, 2008, of which full contents are incorporated herein by reference.

BACKGROUND OF THE INVENTION

1. Field of the Invention

The present invention relates to a light-emitting element driving circuit.

2. Description of the Related Art

Some electronic devices such as a mobile phone include a display device for displaying time, characters and the like with a plurality of LEDs (Light Emitting Diodes) arranged in a matrix manner. One LED in the display device in which the LEDs are arranged in the matrix manner corresponds to a dot, which is a minimum display unit. Thus, in order to produce desired display on the display device, brightness of each LED needs to be set. FIG. 7 illustrates an example of an LED driving circuit 900 for driving a dot matrix LED 800 in which LEDs are arranged in a matrix with 7 rows and 17 columns (See Japanese Patent Laid-Open Publication No. 2003-158300, for example). The LED driving circuit 900 is a circuit for driving the dot matrix LED 800 by a dynamic drive method on the basis of a command and data inputted from a microcomputer 810, and includes a gradation data storage unit 910, an IF (Interface) circuit 911, a controller 912, a scan line driver 913, and a data line driver 914. The gradation data storage unit 910 is a memory circuit for storing gradation data indicating brightness of the LED for each LED in the dot matrix LED 800. The IF circuit 911 transfers to the controller 912 the gradation data outputted from the microcomputer 810, a driving command for instructing the start of the LED driving and the like. The controller 912 sequentially stores in the gradation data storage unit 910 the inputted gradation data corresponding to each LED. Also, when a drive command is inputted, the controller 912 controls the gradation data storage unit 910, the scan line driver 913, and the data line driver 914 so that the driving of the dot matrix LED 800 is started. Specifically, the controller 912 controls the scan line driver 913 so that scan lines 1A to 7A of the dot matrix LED 800 are sequentially selected on the basis of the drive command. Moreover, the controller 912 sequentially reads the gradation data in the gradation data storage unit 910 to be output to the data line driver 914 so that each of the LEDs connected to the selected scan line is driven on the basis of the corresponding gradation data. As a result, the data line driver 914 outputs a driving current according to the gradation data to each of data lines 1B to 17B. Therefore, the dot matrix LED 800 emits light at the brightness according to the gradation data of the gradation data storage unit 910.

If the LED driving circuit 900 fades out predetermined display of the dot matrix LED 800, for example, the LED driving 900 is required to change the gradation data for each dot so that the entire brightness of the dot matrix LED 800 is gradually dimmed. As such, the controller 912 sequentially stores in the gradation data storage unit 910 the gradation data from the microcomputer 810 corresponding to each LED. Then, the data line driver 914 outputs a driving current according to the gradation data stored in the gradation data storage unit 910 to each of the data lines 1B to 17B. Therefore, if the predetermined display is faded out while the dot matrix LED 800 is being driven by the dynamic drive method, the LEDs whose brightness has been updated and those not updated might be mixed in the 17 LEDs connected to the same scan line of the dot matrix LED 800. As a result, brightness of the LEDs in the dot matrix LED 800 might be varied, which is a problem.

SUMMARY OF THE INVENTION

A light-emitting element driving circuit according to an aspect of the present invention, comprises: a PWM signal output circuit configured to output a plurality of PWM signals each having one logic level whose duty ratio corresponds to gradation data and each corresponding to each of a plurality of light-emitting elements, on the basis of the gradation data indicating brightness of each of the plurality of light-emitting elements; a driving signal output circuit configured to change the duty ratio of each of the plurality of inputted PWM signals to output the plurality of changed PWM signals as a plurality of driving signals, on the basis of instruction data for changing the brightness of the plurality of light-emitting elements; and a driving circuit configured to drive the plurality of light-emitting elements on the basis of a duty ratio of each of the plurality of driving signals.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Figure 1:
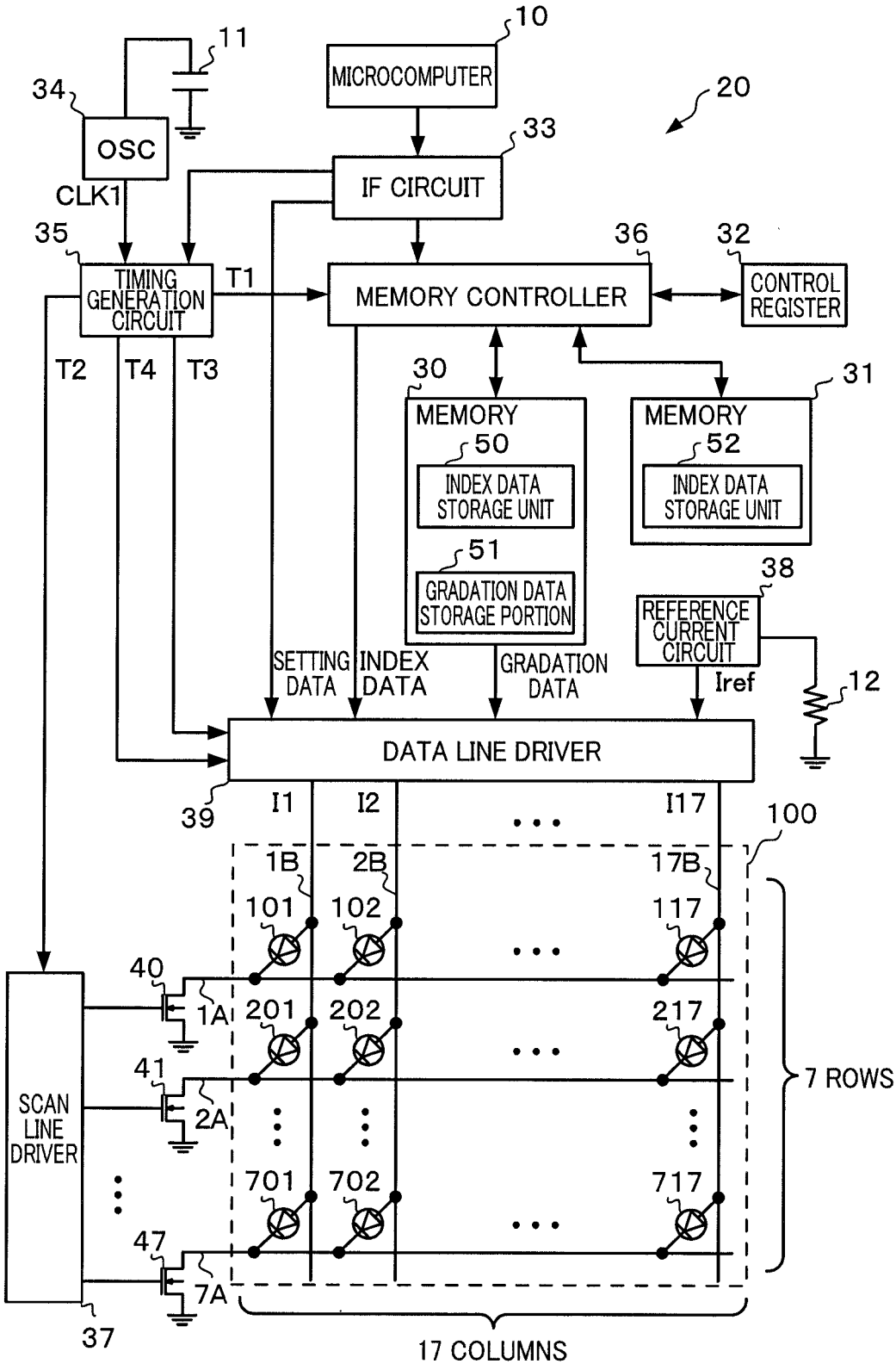
FIG. 1 is a diagram illustrating an LED driving circuit 20 according to an embodiment of the present invention.

FIG. 1 is a diagram illustrating a configuration of an LED driving circuit 20 according to an embodiment of the present invention. The LED driving circuit 20 is a circuit for driving a dot matrix LED 100 by a dynamic drive method according to a command and data outputted from a microcomputer 10. The LED driving circuit 20 includes memory 30, 31, a control register 32, an IF circuit 33, an oscillation circuit (OSC) 34, a timing generation circuit 35, a memory controller 36, a scan line driver 37, a reference current circuit 38, a data line driver 39, and NMOS transistors 40 to 47. The LED driving circuit 20 according to an embodiment of the present invention is assumed to be integrated. The dot matrix LED 100 with 7 rows and 17 columns according to an embodiment of the present invention includes 7 scan lines 1A to 7A, 17 data lines 1B to 17B, and 119 LEDs 101 to 117, 201 to 217, 301 to 317, 401 to 417, 501 to 517, 601 to 617, 701 to 717 arranged in 7 rows and 17 columns. The 7 scan lines 1A to 7A are respectively connected to cathodes of the LEDs arranged in the first row (LEDs 101 to 117) to the LEDs arranged in the seventh row (LEDs 701 to 717). The 17 data lines 1B to 17B are connected to anodes of the LEDs arranged in the first column (LED 101 to 701) to the LEDs arranged in the seventeenth column (LED 117 to 717). As mentioned above, the dot matrix LED 100 according to an embodiment of the present invention is driven by the dynamic drive method. Therefore, though the details will be described later, the scan lines 1A to 7A are sequentially selected, and a driving current corresponding to desired brightness is supplied to each of the LEDs connected to the selected scan line. It is assume that a display device including the microcomputer 10, a capacitor 11, a resistor 12, the LED driving circuit 20, and the dot matrix LED 100 according to an embodiment of the present invention is included in a mobile phone so as to display time, characters and the like, for example.

The memory 30 is a writable memory circuit such as a register and RAM (Random Access Memory) and includes an index data storage unit 50 and a gradation data storage unit 51.

Figure 2:
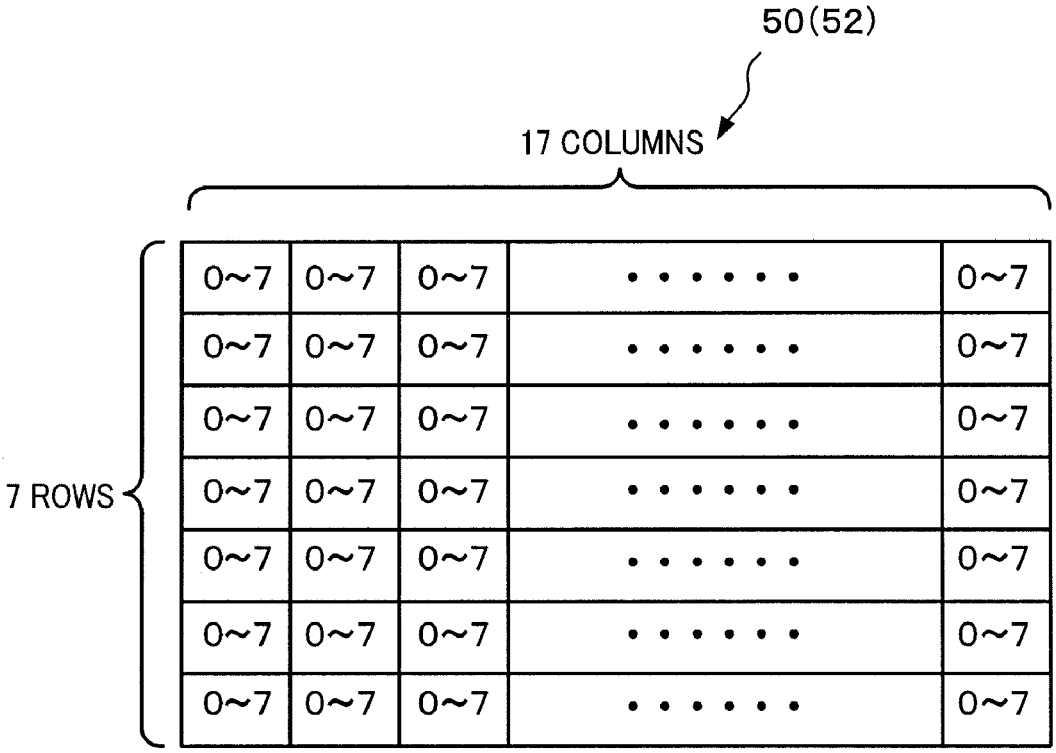
FIG. 2 is a diagram for illustrating a configuration of index data storage units 50 and 52.

The index data storage unit 50 stores, as shown in FIG. 2, index data for each LED for specifying a storage location of gradation data indicating brightness of the LED in the dot matrix LED 100. In an embodiment of the present invention, it is assumed that the index data is 3-bit data, for example. Thus, the index data storage unit 50 stores a value of any of 0 to 7 (decimal number) corresponding to the 3-bit data in a storage area allocated to each LED of the dot matrix LED 100. Therefore, the index data storage unit 50 includes the above-mentioned storage areas in 7 rows and 17 columns. Moreover, in an embodiment of the present invention, the index data stored in the storage area in the first row and the first column corresponds to the index data of the LED 101, and the index data stored in the storage area in the first row and the second column corresponds to the index data of the LED 102, for example. As such, the index data stored in the storage area in the n-th row and the m-th column of the index data storage unit 50 corresponds to the index data of the LED arranged in the n-th row and the m-th column. In an embodiment of the present invention, the index data stored in the storage area in the n-th row and the m-th column is referred to as index data (n, m).

Figure 3:
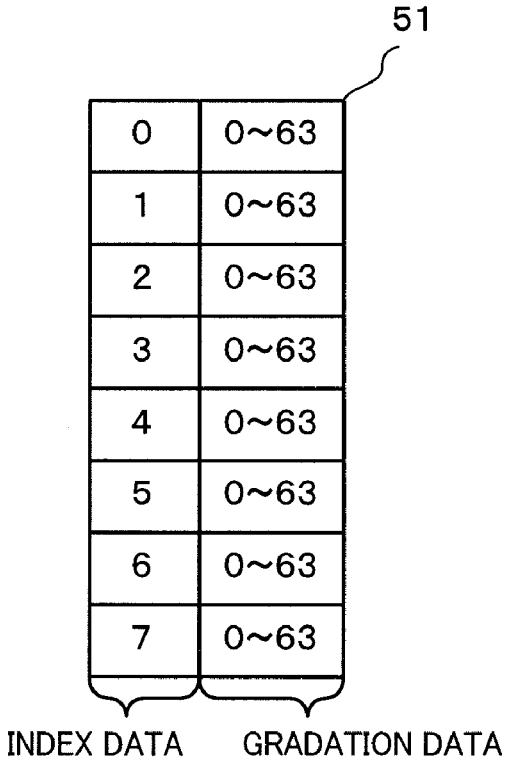
FIG. 3 is a diagram for illustrating a configuration of a gradation data storage unit 51.

The gradation data storage unit 51 stores the gradation data corresponding to index data. It is assumed that the gradation data according to an embodiment of the present invention is 6-bit data, for example. The gradation data storage unit 51 is, as shown in FIG. 3, includes 8 storage areas each capable of storing 6-bit gradation data. In FIG. 3, the 6-bit gradation data stored in the first row, for example, is the gradation data corresponding to the index data "0" (decimal number), and the 6-bit gradation data stored in the second row is the gradation data corresponding to the index data "1" (decimal number). As such, according to an embodiment of the present invention, the index data values of "0" to "7" (decimal number) respectively correspond to the gradation data stored in the first to eighth rows. Each of the gradation data stored in the gradation data storage unit 51 is outputted to the data line driver 39.

The memory 31 is a writable memory circuit such as a register, RAM and the like, similarly to the memory 30, and includes an index data storage unit 52.

The index data storage unit 52 stores, similarly to the index data storage unit 50, index data for each LED for specifying a storage location of the gradation data indicating brightness of the LED in the dot matrix LED 100.

The control register 32 stores control data for allowing the memory controller 36 to select either the index data storage unit 50 or the index data storage unit 52 to store the index data. Assuming that the control data according to an embodiment of the present invention is 1-bit data, for example, if the control data is "0", the memory controller 36 selects the index data storage unit 50 as a storage location of the index data, while if the control data is "1", the memory controller 36 selects the index data storage unit 52 as the storage location of the index data. In an embodiment of the present invention, it is assumed that predetermined addresses are assigned to the storage areas for storing each of the index data, the gradation data, and the control data.

The IF circuit 33 transfers to the memory controller 36 the index data, the gradation data, and the control data inputted from the microcomputer 10. The IF circuit 33 also transfers to the timing generation circuit 35 a driving command inputted from the microcomputer 10 for instructing a start of driving the dot matrix LED 100. Moreover, the IF circuit 33 transfers to the data line driver 39 setting data inputted from the microcomputer 10 for fading in/fading out display of the dot matrix LED 100, for example.

The oscillation circuit 34 is a circuit for generating a clock signal with a period corresponding to a capacity value of the capacitor 11.

The timing generation circuit 35 stores a driving command in the register (not shown) provided in the timing generation circuit 35 when the driving command is inputted from the IF circuit 33. The timing generation circuit 35 also controls the memory controller 36, the scan line driver 37, and the data line driver 39 so that the dot matrix LED 100 is driven by the dynamic drive method on the basis of the driving command and a clock signal CLK1. Specifically, the timing generation circuit 35 respectively outputs timing signals T1 to T3 to the memory controller 36, the scan line driver 37, and the data line driver 39 on the basis of the driving command and the clock signal CLK1. Though the details will be described later, the data line driver 39 according to an embodiment of the present invention drives the dot matrix LED 100 by driving currents I1 to I17 which are PWM (Pulse Width Modulation) controlled. The timing generation circuit 35 according to an embodiment of the present invention generates a timing signal T4 with a predetermined period for generating the PWM-controlled driving currents I1 to I17 by the data line driver 39, on the basis of the driving command and the clock signal CLK1.

The memory controller 36 stores the control data inputted from the IF circuit 33 in the control register 32 and the gradation data inputted from the IF circuit 33 in the gradation data storage unit 51. On the basis of the control data stored in the control register 32, the controller stores the index data inputted from the IF circuit 33 in either of the index data storage units 50 and 52. Specifically, if the control data stored in the control register 32 is "0", the memory controller 36 stores the index data in the index data storage unit 50. On the other hand, if the control data stored in the control register 32 is "1", the memory controller 36 stores the index data in the index data storage unit 52. The memory controller 36 also obtains the index data stored in either of the index data storage units 50 and 52 on the basis of the timing signal T1 from the timing generation circuit 35, to be sequentially output to the data line driver 38, so that the dot matrix LED 100 is driven by the dynamic drive method. The memory controller 36 according to an embodiment of the present invention obtains the index data from the index data storage unit 52 if the control data is "0", and obtains the index data from the index data storage unit 50 if the control data is "1". Also, if the memory controller 36 outputs the index data of the index data storage unit 50, for example, the controller outputs index data (1, 1) in the index data storage unit 50, first, and then outputs the index data (1, 2), (1, 3), so as to output the index data of the adjacent columns in the same row sequentially. When the index data (1, 17) is outputted, the memory controller 36 obtains the index data (2, 1) in the first column in the subsequent row, to be output. As such, the memory controller 36 obtains the index data (1, 1) in the first row and the first column to be sequentially output row by row. Then, when the index data (7, 17) in the seventh row is outputted, the memory controller 36 obtains the index data in the first row again to be sequentially output. The memory controller 36 outputs the index data stored in the index data storage unit 52 in the same manner as in the case of the index data storage unit 50.

The scan line driver 37 is a circuit for sequentially turning on the NMOS transistors 40 to 47 on the basis of the timing signal T2 from the timing generation circuit 35. In an embodiment of the present invention, drains of the NMOS transistors 40 to 47 are connected to the scan lines 1A to 7A, respectively, and sources thereof are connected to ground GND. Therefore, when the NMOS transistor 40 is turned on, for example, the scan line 1A in the scan lines 1A to 7A becomes substantially equal in potential to the ground GND. In a state where the scan line 1A is equal in potential to the ground GND, that is, in a sate where the scan line 1A is selected, when the data line driver 39 outputs a driving current to the data lines 1B to 17B, the driving current flows through the LEDs 101 to 117 connected to the scan line 1A. In this case, the driving current does not flow through the LED connected to the scan lines 2A to 7A which are not selected. The scan line driver 37 sequentially turns on the NMOS transistors 40 to 47 on the basis of the timing signal T2, and thus, the scan lines 1A to 7A of the dot matrix LED 100 according to an embodiment of the present invention are sequentially selected.

The reference current circuit 38 is a circuit for generating a reference current Iref, which is used as a reference of a driving current outputted to the data lines 1B to 17B by the data line driver 39, according to a resistance value of the resistor 12.

Figure 4:
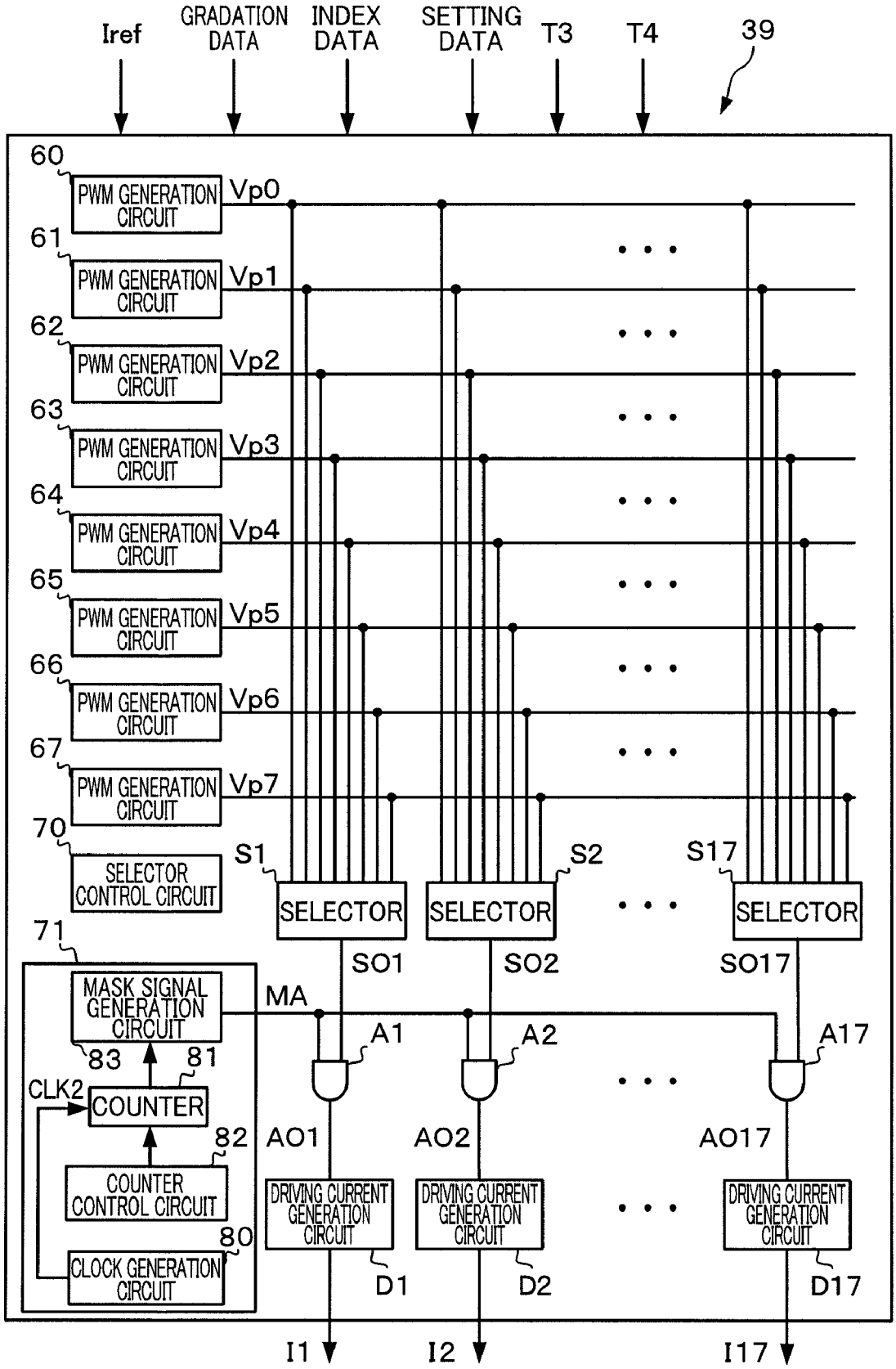
FIG. 4 is a diagram illustrating an embodiment of a data line driving circuit 39.

The data line driver 39 is a circuit for outputting driving currents I1 to I17 corresponding to the reference current Iref, the index data, and the gradation data to the data lines 1B to 17B on the basis of the timing signals T3 and T4 from the timing generation circuit 35. Also, the data line driver 39 changes the driving currents I1 to I17 on the basis of the setting data when the setting data for fading in/fading out the predetermined display of the dot matrix LED 100 is inputted, for example. The data line driver 39 is, as shown in FIG. 4, includes PWM generation circuits 60 to 67, a selector control circuit 70, a mask signal output circuit 71, selectors S1 to S17, AND circuits A1 to A17, and driving current generation circuits D1 to D17. The PWM generation circuits 60 to 67, the selector control circuit 70, and the selectors S1 to S17 of an embodiment of the present invention correspond to the PWM signal output circuit, and the mask signal output circuit 71 and the AND circuits A1 to A17 correspond to a driving signal output, and the driving current generation circuits D1 to D17 correspond to a driving circuit.

The PWM generation circuit 60 is a circuit for generating a PWM signal Vp0 with the same period as that of the timing signal T4 on the basis of the gradation data stored in the storage area of the gradation data storage unit 51 corresponding to the index data "0" (decimal number) and the timing signal T4 with a predetermined period. Specifically, in an embodiment of the present invention, a duty ratio of the PWM signals Vp0 at a high-level (hereinafter referred to as H-level) is a duty ratio according to the gradation data of a storage area corresponding to the index data "0". Moreover, in an embodiment of the present invention, it is assumed that if the above gradation data is "0" (decimal number), the duty ratio of the H-level is 0%, and the duty ratio of the H-level is increased according to an increase of a value of the gradation data. It is assumed that if the gradation data becomes "63" (decimal number), the duty ratio of the H-level becomes 100%. It is assumed that if the duty ratio of the PWM signal Vp0 in an embodiment of the present invention is not 0%, a logic level of the PWM signal Vp0 becomes the H level at timing of a start of one period of the PWM signal Vp0.

The PWM generation circuits 61 to 67 generate, as in the case of the PWM generation circuit 60, the PWM signals Vp1 to Vp7 according to the gradation data stored in the storage area of the gradation data storage unit 51 respectively corresponding to the index data "1" to "7" (decimal number) and the timing signal T4. In an embodiment of the present invention, it is assumed that the period of each of the PWM signals Vp1 to Vp7 and the timing when the PWM signals Vp1 to Vp7 reaches the H level are the same as those in the case of the PWM signal Vp0.

The selector control circuit 70 stores the index data sequentially outputted from the memory controller 36 in such an order that the data is outputted. For example, if one row of index data in the index data storage unit 50, that is, 17 pieces of the 3-bit index data are stored at timing based on the timing signal T3, the 17 pieces of index data are respectively outputted to the selectors S1 to S17. The timing when the selector control circuit 70 outputs one row of index data is set so as to become the same timing as that when any one of the scan lines 1A to 7A is selected. As such, the memory controller 36 in an embodiment of the present invention sequentially outputs the index data in the adjacent columns from the index data (1, 1) in the first row. Therefore, in the selector control circuit 70, the index data in any of the first to seventh rows is stored as the one row of index data. If the index data in the first row of the index data storage unit 50 is stored in the selector control circuit 70, for example, the index data (1, 1) for the first row and the first column is outputted to the selector S1. Also, the index data (1, 2) for the first row and the second column to the index data (1, 17) for the first row and the seventeenth column are outputted to the selector S2 to the selector S17, respectively. The same is the case where the index data in another row is stored in the selector control circuit 70. Moreover, the case where the index data is outputted from the index data storage unit 52 is also the same as the case where it is outputted from the index data storage unit 50. Then, in an embodiment of the present invention, after the selector control circuit 70 outputs the one row of index data, the memory controller 36 sequentially outputs the index data in the subsequent row on the basis of the timing signal T2. Therefore, the selector control circuit 70 according to an embodiment of the present invention can be realized by providing a storage area capable of storing one row of index data, for example.

The selector S1 stores the index data outputted from the selector control circuit 70, selects any one of the PWM signals Vp0 to Vp7 from the PWM generation circuits 60 to 67 on the basis of the stored index data, and output the selected one to the AND circuit A1 as a selection signal SO1. If the index data with the value "0" (decimal number) is stored, for example, the selector S1 outputs the PWM signal Vp0 as the selection signal SO1. As in the case with the above case, assuming that the values of the index data are "1" to "7", any one of the PWM signals Vp1 to Vp7 respectively corresponding to the values of the index data "1" to "7" is outputted as the selection signal SO1. It is assumed that the selector S1 according to an embodiment of the present invention includes a register (not shown) for storing the 3-bit index data outputted from the selector control circuit 70, and the register is updated each time the index data is outputted from the selector control circuit 70. Also, as mentioned above, the index data for the first column out of the 17 pieces of the index data in one row that is stored in the selector control circuit 70 is outputted to the selector S1. Thus, the index data (1, 1) to (7, 1) is repeatedly stored in the register of the selector S1.

Each of the selectors S2 to S17 selects, as in the case of the selector S1, any one of the PWM signals Vp0 to Vp7 on the basis of each of the values of the index data corresponding to the second column to the seventeenth column out of the 17 pieces of index data for one row stored in the selector control circuit 70. Then, each of the selectors S2 to S17 outputs the selection signals SO2 to SO17.

The mask signal output circuit 71 (output circuit) is a circuit for outputting a mask signal MA for changing the duty ratios of the selection signals SO1 to SO17 on the basis of the setting data for fade-in/fade-out, for example. The mask signal output circuit 71 includes a clock generation circuit 80, a counter 81, a counter control circuit 82, and a mask signal generation circuit 83.

The clock generation circuit 80 is a circuit for generating a clock signal CLK2 with a predetermined period, for example.

The counter 81 is an up/down counter for changing the count value on the basis of the setting data stored in a counter control circuit 82, which will be described later, and the clock signal CLK 2. It is assumed that the counter 81 according to an embodiment of the present invention is a 6-bit counter, for example. Therefore, the count value of the counter 81 is changed between "0" and "63" (decimal number).

The counter control circuit 82 stores setting data indicating whether or not to fade in predetermined display of the dot matrix LED 100 or whether or not to fad it out. Also, the counter control circuit 82 sets an initial value of the count value of the counter 81 on the basis of the stored setting data, and controls the counter 81 as to being operated as an up counter or operated as a down counter. In an embodiment of the present invention, when the setting data for fade-in is stored in the counter control circuit 82, the counter control circuit 82 sets the count value of the counter 81 at "0" (decimal number) and allows the counter 81 to be operated as the up counter. On the other hand, when the setting data for fade-out is stored in the counter control circuit 82, the counter control circuit 82 sets the count value of the counter 81 at "63" (decimal number) and allows the counter 81 to be operated as the down counter. Also, when the setting data for neither fade-in nor fade-out is stored in the counter control circuit 82, the counter control circuit 82 fixes the count value of the counter 81 at "63". The counter control circuit 82 according to an embodiment of the present invention includes a register capable of storing the setting data, for example. Also, in an embodiment of the present invention, the maximum count value when the counter 81 is operated as the up counter is "63" (decimal number), while the minimum count value when the counter 81 is operated as the down counter is "0" (decimal number).

The mask signal generation circuit 83 (output signal generation circuit) is a circuit for generating the mask signal MA with the same period as that of each of the PWM signals Vp0 to Vp7, and the duty ratio corresponding to the count value of the counter 81, on the basis of the timing signal T4 and the count value of the counter 81. In an embodiment of the present invention, it is assumed that if the count value of the counter 81 is "0" (decimal number), the duty ratio of the H level is 0%, and the duty ratio of the H level is increased according to the increase of the count value. It is also assumed that if the count value reaches "63" (decimal number), the duty ratio of the H level becomes 100%. In an embodiment of the present invention, it is assumed that when the duty ratio of the mask signal MA is not 0%, the mask signal MA reaches the H level at the timing when the PWM signals Vp0 to Vp7 reaches the H level on the basis of the timing signal T4.

The AND circuit A1 is a circuit for performing a logical multiplication of the selection signal SO1 outputted from the selector S1 and the mask signal MA from the mask signal output circuit 71, to be outputted as an output signal AO1. As mentioned above, the selector S1 outputs any one of the PWM signals Vp0 to VP7 as the selection signal SO1. Each of the PWM signals Vp0 to VP7 and the mask signal MA have the same period. Moreover, the timing when the PWM signals Vp0 to VP7 and the mask signal MA reaches the H level is the same. Therefore, if the duty ratio of the mask signal MA is smaller than the duty ratio of the selection signal SO1, for example, the duty ratio of the output signal AO1 becomes the same as the duty ratio of the mask signal MA. On the other hand, if the duty ratio of the mask signal MA is greater than the duty ratio of the selection signal SO1, the duty ratio of the output signal becomes the same as the duty ratio of the selection signal SO1.

The AND circuits A2 to A17 are circuits for performing the logical multiplications of the selection signals SO2 to SO17 respectively outputted from the selectors S2 to S17 and the mask signal MA, to be outputted as the output signals AO2 to AO17, as in the case of the AND circuit A1. Thus, the duty ratios of the output signals AO2 to AO17 outputted from the AND circuits A2 to A17 are determined on the basis of the duty ratio of the mask signal MA and the duty ratios of the selection signals SO2 to SO17. Each of the AND circuits A1 to A17 corresponds to a driving signal generation circuit.

Figure 5:
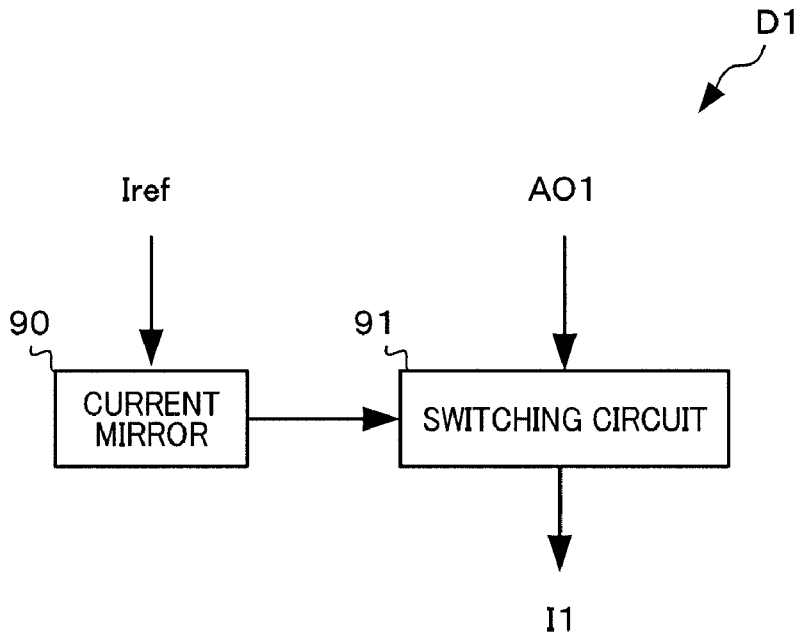
FIG. 5 is a diagram illustrating an embodiment of a driving current generation circuit D1.

The driving current generation circuit D1 is a circuit for generating a driving current I1 of a current value corresponding to the duty ratio of the H-level of the output signal AO1 outputted from the AND circuit A1. The driving current generation circuit D1 includes, as shown in FIG. 5, for example, a current mirror 90 and a switching circuit 91.

The current mirror 90 is a circuit for generating a current corresponding to the inputted reference current Iref and be outputting the current to the switching circuit 91.

The switching circuit 91 is a circuit for changing the current from the current mirror 90 according to the duty ratio of H-level of the inputted output signal AO1 and outputting the current as the driving current I1. In an embodiment of the present invention, it is assumed that when the duty ratio of the output signal AO1 is zero, the current value of the driving current I1 is zero, and the current value of the driving current I1 increases according to the increase in the duty ratio of H-level of the output signal AO1. Also, when the duty ratio of the output signal AO1 becomes 100%, the driving current I1 becomes Imax that is the maximum value.

The driving current generation circuits D2 to D17 have the same configuration as that of the driving current generation circuit D1, and respectively output the driving currents I2 to I17 of the current values according to the reference current Iref and the duty ratios of the output signals AO2 to AO17.

<Example of Fade-In/Fad-Out of Predetermined Display>

An example will be described of an operation of the LED driving circuit 20 when predetermined display in the dot matrix LED 100 is faded in/faded out. Here, the LED driving circuit 20 allows the dot matrix LED 100 to display a time of "12:00", for example, as the predetermined display. When a mobile phone (not shown) including the dot matrix LED 100 receives an e-mail, the LED driving circuit 20 fades out the display of "12:00" and fades in the characters of "Mail" in the display. In an embodiment of the present invention, it is assumed that the time "12:00" is displayed by allowing the LED corresponding to the storage area storing the index data "1" (decimal number) to emit light and by allowing the LED corresponding to the storage area storing the index data "0" (decimal number) not to emit light. Here, it is also assumed that the control data stored in the control register 32 is "1" and the index data for displaying "12:00" is stored in the index data storage unit 50. Therefore, the data line driver 39 drives the dot matrix 100 on the basis of the index data stored in the index data storage unit 50. Moreover, the gradation data "0" (decimal number) is stored in each of the storage areas corresponding to the index data "0" and "2" to "7" (decimal number) in the gradation data storage unit 51, and the gradation data "50" (decimal number), for example, is stored in the storage area corresponding to the index data "1" (decimal number). Therefore, the duty ratio of the PWM signal Vp0 of the PWM generation circuit 60 and each of the duty ratios of the PWM signals Vp2 to Vp7 respectively corresponding to the PWM generation circuits 62 to 67 become 0%. On the other hand, it is assumed that the duty ratio of the PWM Vp1 of the PWM signal of the PWM generation circuit 61 is 80%, for example, on the basis of the gradation data "50". It is also assumed that the setting data for neither fading in nor fading out is stored in the counter control circuit 82. Therefore, since the count value of the counter 81 reaches "63" (decimal number), the mask signal MA from the mask signal output circuit 71 reaches the H level.

First, the LED driving circuit 20 allowed the time of "12:00" to be displayed as the predetermined display on the dot matrix LED 100 as mentioned above. Specifically, the memory controller 36 obtains the index data stored in the index data storage unit 50 to sequentially outputted to the data line driver 39. As a result, in the selector control circuit 70, the index data is sequentially stored. Then, at the timing when the 17 pieces of the index data in the first row of the index data storage unit 50 is stored in the selector control circuit 70, the timing generation circuit 35 allows the selector control circuit 70 to output the 17 pieces of the index data to the selectors S1 to S17, respectively. As mentioned above, the index data used in the display of "12:00" is "0" or "1" (decimal number). Therefore, each of the selectors S1 to S17 selects either the PWM signal VP0 corresponding to the index data "0" (decimal number) or the PWM signal Vp1 according to the index data "1" (decimal number) and outputs the selected signal. Specifically, in the 17 pieces of index data in the first row, for example, in the case where only the index data (1, 1) for the first column is "1" (decimal number) and other index data is "0" (decimal number), only the selection signal SO1 outputted from the selector S1 in the selectors S1 to S17 is the PWM signal Vp1. On the other hand, each of the selection signals SO2 to SO17 of other selectors S2 to S17 is the PWM signal Vp0. Also, since the logic level of the mask signal MA is H and the duty ratios of the PWM signals Vp0 and Vp1 are 0% and 80%, respectively, the duty ratio of the output signal AO1 in the output signals AO1 to AO17 results in 80%, while each of the duty ratios of the output signals AO2 to AO17 is 0%. Thus, only the current value of the driving current I1 has a current value Ix according to the duty ratio 80%, while each of the current values of the driving currents I2 to I17 is zero. Also, the timing generation circuit 35 of an embodiment of the present invention allows the selector control circuit 70 to output the 17 pieces of index data on the basis of the timing signal T3, and allows the scan line driver 37 to turn on the NMOS transistor 40 on the basis of the timing signal T2. Therefore, the driving currents I1 to I17 respectively flow through the LEDs 101 to 117 on the first row in the dot matrix LED 100. Thus, in the case where only the above index data (1, 1) is "1" (decimal number), for example, only the LED 101, through which the driving current I1 flows, in the LEDs 101 to 117 emits light at brightness according to the current value Ix, while the LEDs 102 to 117 do not emit light. Also, as mentioned above, the timing generation circuit 35 controls each of the memory controller 36, the scan line driver 37, the data line driver 39 so that the dot matrix LED 100 is driven by a dynamic drive method. Thus, each time the 17 pieces of index data for each row in the index data storage unit 50 are stored in the selectors S1 to S17, an operation is repeated of turning on the NMOS transistor in the corresponding column. As a result, "12:00" is displayed on the dot matrix LED 100 at the brightness according to the gradation data "50".

Subsequently, there will be described an operation of the LED driving circuit 20 when a mobile phone (not shown) receives an e-mail and the display of "12:00" is faded out. In an embodiment of the present invention, it is assumed that the index data "1" (decimal number) is stored in each of the storage areas corresponding to the light emitting elements 101 to 701 in the first column of the index data storage unit 50, for example, in order to display "12:00". Thus, if the LED driving circuit 20 displays "12:00", the PWM signal Vp1 is always selected and outputted as the selection signal SO1 from the selector S1.

Figure 6:
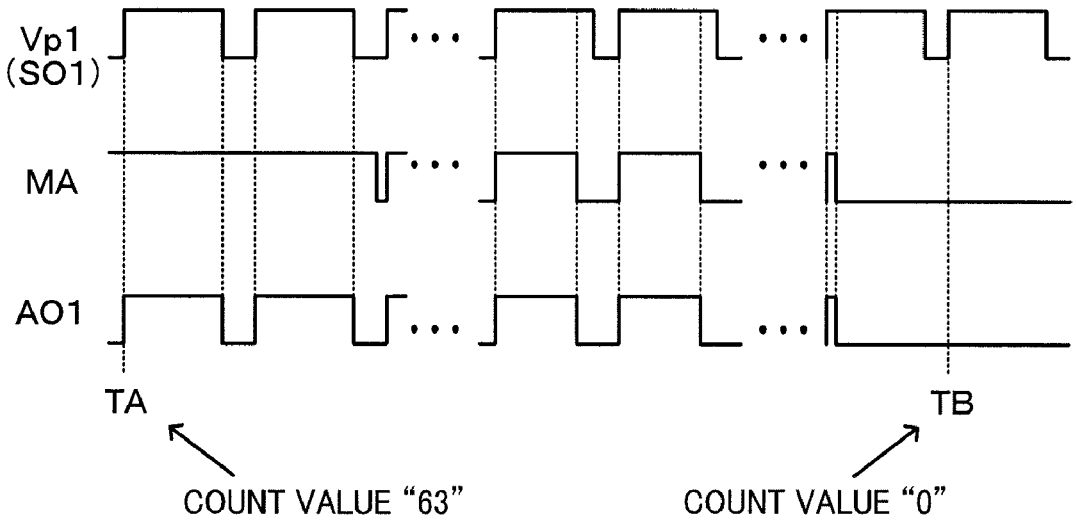
FIG. 6 is a timing chart illustrating examples of transitions of major signals in a data line driver 39 when display of a dot matrix LED 100 is faded out.
Figure 7:
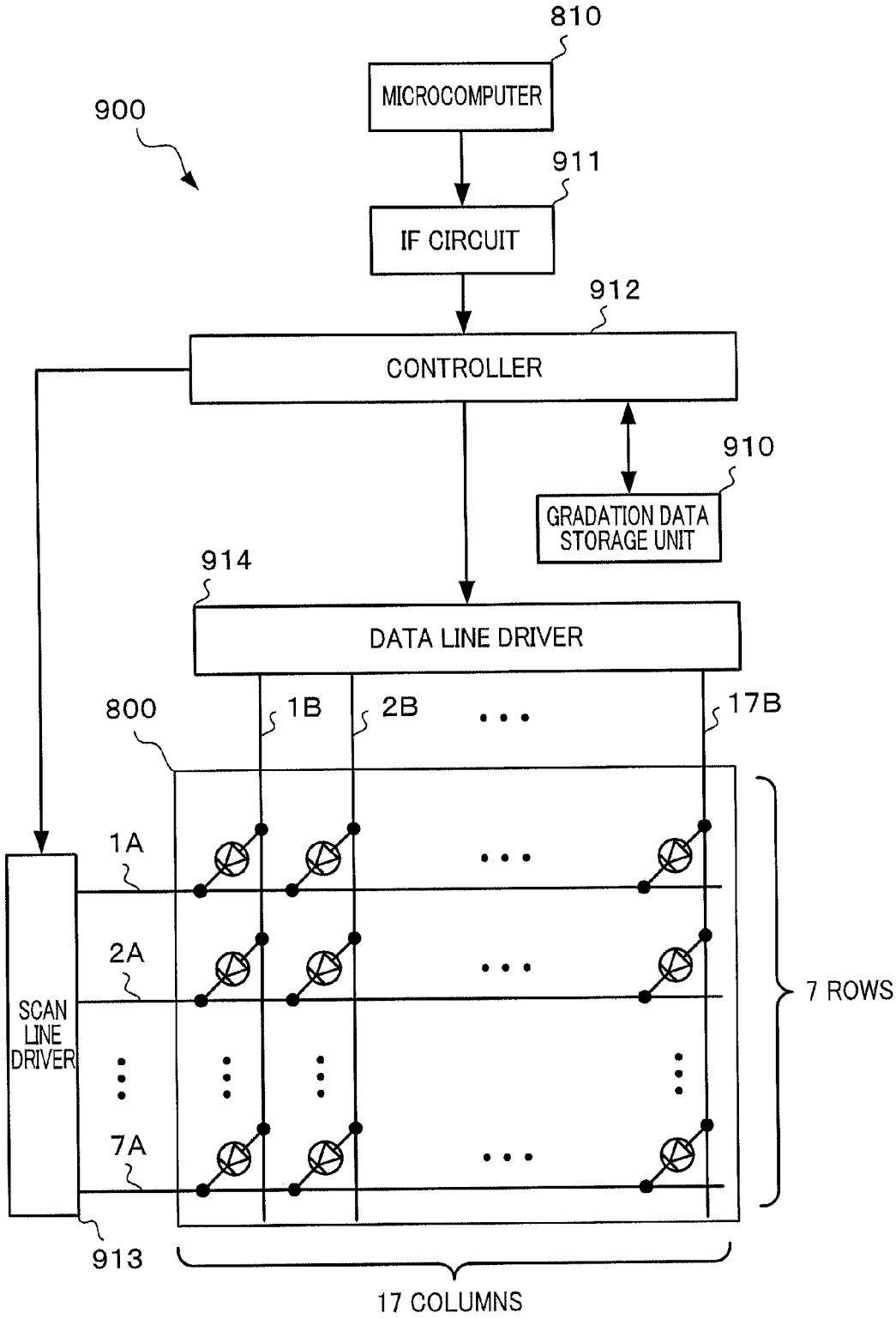
PRIOR ART FIG. 7
FIG. 7 is a diagram illustrating an example of an LED driving circuit for driving a dot matrix LED.

If the mobile phone receives an e-mail, a system microcomputer (not shown) controlling the mobile phone in a centralized manner outputs to the microcomputer 10 an instruction for fading out the display of "12:00". Then, the microcomputer 10 outputs to the IF circuit 33 the setting data for fading out the display of "12:00". The setting data for fade-out is stored in the counter control circuit 82 of the data line driver 39 through the IF circuit 33. Thus, the counter control circuit 82 sets the count value of the counter 81 at "63" and operates the counter 81 as the down counter. FIG. 6 shows an example of change in major signals of the data line driver 39 when the count value of the counter 81 is decreased from "63" to "0" (decimal number) with a predetermined period on the basis of the clock signal CLK2. In an embodiment of the present invention, it is assumed that the period of the clock signal CLK2, during which the count value of the counter 81 is changed, is longer than the period of the PWM signal Vp1. For example, if the setting data for fade-out is stored in the counter control circuit 82 at a time TA, the mask signal generation circuit 83 outputs the H-level mask signal MA on the basis of the count value "63" of the counter 81. Here, the selector S1 outputs the PWM signal Vp1 as the selection signal SO1, and the AND circuit A1 performs the logical multiplication of the selection signal SO1 and the mask signal MA. Therefore, from the AND circuit A1, the output signal AO1 with the same duty ratio as the duty ratio of the PWM signal Vp1 is outputted. Then, if the count value of the counter 81 is decreased on the basis of the clock signal CLK2, the duty ratio of the mask signal MA is decreased. As mentioned above, since the output signal AO1 is changed according to a operation result of the logical multiplication of the selection signal SO1 and the mask signal MA, if the duty ratio of the mask signal MA is greater than the duty ratio of the selection signal SO1, the duty ratio of the output signal AO1 becomes equal to the duty ratio of the selection signal SO1. On the other hand, if the count value of the counter 81 is decreased, and the duty ratio of the mask signal MA becomes smaller than the duty ratio of the selection signal SO1, the duty ratio of the output signal AO1 is decreased with the duty ratio of the mask signal MA. Also, the driving current generation circuit D1 according to an embodiment of the present invention generates the driving current I1 having a current value according to the duty ratio of the output signal AO1. Therefore, the current value of the driving current I1 is decreased according to drop in the duty ratio of the output signal AO1 and becomes zero at a time TB. Here, there is described the change in the driving current I1 in a case where the selector S1 selects the PWM signal Vp1 to be output as the selection signal SO1, but the change in the driving currents I2 to I17 in a case where other selectors S2 to S17 each selects the PWM signal Vp1 is also the same. That is, in an embodiment of the present invention, each of the duty ratios of the output signals AO2 to AO17 in the case where each of the selectors S2 to S17 selects the PWM signal Vp1 also becomes smaller according to the drop in the duty ratio of the mask signal MA, if the duty ratio of the mask signal MA becomes smaller than the duty ratio of the PWM signal Vp1. Also, while the count value of the counter 81 is decreased, the scan line driver 37 and the data line driver 39 continue to drive the dot matrix LED 100 by the dynamic drive method. Therefore, the display of "12:00" in the dot matrix LED 100 is faded out according to the drop in the count value of the counter 81.

There will be described an operation of the LED driving circuit 20 of fading in the display of "Mail" after the display of "12:00" is faded out. Here, it is assumed that while the LED driving circuit 20 is fading out the display of "12:00" of the dot matrix LED 100, the index data for displaying the "Mail" is stored in the index data storage unit 52. Also, in an embodiment of the present invention, it is assumed that "Mail" is displayed by allowing the LED corresponding to the storage area storing the index data "1" (decimal number) to emit light and by allowing the LED corresponding to the storage area storing the index data "0" (decimal number) not to emit light. Also, in the gradation storage unit 51, similarly to the above, the gradation data "0" (decimal number) is stored in each of the storage areas corresponding to the index data "0" and "2" to "7" (decimal number), while in the storage area corresponding to the index data "1" (decimal number), the gradation data "50" (decimal number) is stored, for example.

If an instruction for fading in the display of "Mail" is inputted to the microcomputer 10 from the system microcomputer (not shown) controlling the mobile phone (not shown) in the centralized manner, the microcomputer 10 outputs the control data "0" to the IF circuit 33 so as to update the control data stored in the control register 32. If the memory controller 36 stores the control data "0" in the control register 32, the memory controller 36 obtains the index data stored in the index data storage unit 52 to be output to the data line driver 39. As a result, the selection signals SO1 to SO17 on the basis of the index data stored in the index data storage unit 52 are outputted from the selectors S1 to S17 in the data line driver 39. As mentioned above, in an embodiment of the present invention, it is assumed that "Mail" is displayed by allowing the LED corresponding to the storage area storing the index data "1" (decimal number) to emit light and by allowing the LED corresponding to the storage area storing the index data "0" (decimal number) not to emit light. Therefore, either the PWM signal Vp0 or the PWM signal Vp1 is selected to be outputted as each of the selection signals SO1 to SO17. The count value of the counter 81 becomes "0" when the display of "12:00" is faded out. That is, since the duty ratio of the mask signal MA is 0%, even if the PWM signal Vp1 is outputted as each of the selection signals SO1 to SO17, the current values of the driving currents I1 to I17 results in zero. Therefore, while the count value of the counter 81 is "0", the display of "Mail" is not displayed on the dot matrix LED 100. Also, the microcomputer 10 outputs the setting data for fade-in to the IF circuit 33 on the basis of the instruction for fading in the display of "Mail". The setting data for fade-in is stored in the counter control circuit 82 of the data line driver 39 through the IF circuit 33. Thus, the counter control circuit 82 sets the count value of the counter 81 at "0" and operates the counter 81 as the up counter. Then, the counter 81 increases the count value with a predetermined period on the basis of the clock signal CLK2. As a result, the duty ratio of the mask signal MA from the mask signal generation circuit 83 becomes greater according to the increase of the count value. While the count value of the counter 81 is increased, the scan line driver 37 and the data line driver 39 continue to drive the dot matrix LED 100 by a dynamic drive method. Therefore, until a time when the duty ratio of the mask signal MA becomes equal to 80% of the duty ratio of the PWM signal Vp1 which is determined on the basis of the gradation data "50" (decimal number), the display of "Mail" gets brighter with the increase of the count value. As such, the display of "Mail" on the dot matrix LED 100 is faded in with the increase of the count value of the counter 81.

In the LED driving circuit 20 according to an embodiment of the present invention with the above-described configuration, the selectors S1 to S17 each selects any one of the PWM signals Vp0 to Vp7, whose duty ratio of the H-level is changed according to the gradation data, to be output as the selection signals SO1 to SO17, respectively. Also, the mask signal output circuit 71 and the AND circuits A1 to A17 change the duty ratios of the selection signals SO1 to SO17 inputted to the AND circuits A1 to A17 on the basis of the setting data for fade-in or fade-out, to be output as the output signals AO1 to A17, respectively. The driving current generation circuits D1 to D17 generate the driving currents I1 to I17 on the basis of the duty ratios of the output signals AO1 to AO17, to drive the dot matrix LED 100. Thus, when the dot matrix LED 100 is driven by a dynamic drive method, the brightness of the plurality of LEDs connected to the same scan line can be changed at the same timing. That is, the LED driving circuit 20 according to an embodiment of the present invention can suppress a time lag when the brightness is changed of the plurality of LEDs connected to the same scan line.

Also, in the LED driving circuit 20 according to an embodiment of the present invention, the duty ratio of each of the selection signals SO1 to SO17 is changed on the basis of the mask signal MA, in which the period is the same as that of each of the PWM signals Vp0 to Vp7 and the duty ratio of the H-level is changed according to the setting data. Since the period of each of the PWM signals Vp0 to Vp7 and the period of the mask signal MA are the same, the period of each of the output signals AO1 to AO17 becomes the same as that of each of the PWM signals Vp0 to Vp7, consequently. Thus, even if the LED driving circuit 20 changes the duty ratio of the mask signal MA so as to fade in the predetermined display, for example, the period of each of the output signals AO1 to AO17 is not changed, so that the period is not changed with which each LED of the dot matrix LED 100 emits light. Therefore, in an embodiment of the present invention, the brightness of the plurality of LEDs connected to the same scan line can be changed at the same timing, and the LED can be allowed to emit light with the predetermined period.

Also, the mask signal generation circuit 83 according to an embodiment of the present invention sets the mask signal MA at the H level at the timing when the PWM signals Vp0 to Vp7 reach the H level, on the basis of the timing signal T4. Also, the mask signal generation circuit 83 changes the duty ratio of the H-level of the mask signal MA according to the count value of the counter 81. For example, even if the timing when the PWM signals Vp0 to Vp7 reach the H level does not coincide with the timing when the mask signal MA reaches the H level, it is possible to change the duty ratio of each of the output signals AO1 to AO17. However, in this case, it is difficult to set the duty ratio of each of the output signals AO1 to AO17 at a desired duty ratio. In an embodiment of the present invention, as mentioned above, by allowing the timing when the mask signal MA reaches the H level to coincide with the timing when the PWM signals Vp0 to Vp7 reach the H level and allowing the duty ratio of the mask signal MA to change according to the count value, the output signals AO1 to AO17 with the desired duty ratio can be reliably generated. Moreover, in an embodiment of the present invention, the count value of the counter 81 is changed on the basis of the clock signal CLK2 with the predetermined period. Therefore, by changing the period of the clock signal CLK2, for example, a rate of change in the LED brightness can also be adjusted.

The driving current generation circuits D1 to D17 according to an embodiment of the present invention increase the driving currents I1 to I17 with the increase of the duty ratios of the H-level of the output signals AO1 to AO17. Thus, if the duty ratios of the output signals AO1 to AO17 are increased, the brightness of the LEDs in the dot matrix LED 100 is increased. The count value of the counter 81 is increased from "0" to "63" (decimal number) on the basis of the setting data indicating fade-in. As a result, the duty ratios of the output signals AO1 to AO17 are changed from 0% to the predetermined duty ratios according to the gradation data. On the other hand, on the basis of the setting data indicating fade-out, the count value of the counter 81 is decreased from "63" to "0" (decimal number). As a result, the duty ratios of the output signals AO1 to AO17 are changed from the predetermined duty ratios according to the gradation data to 0%. For example, in a case where the gradation data is changed to fade in the predetermined display, it is necessary for the microcomputer 10 to sequentially output the gradation data from "0" to "63" to the IF circuit 33. The LED driving circuit 20 according to an embodiment of the present invention is able to allow the predetermined display to be faded in, for example, without changing the gradation data, and thus, a data amount to be transferred by the microcomputer 10 and the IF circuit 33 can be decreased.

The above embodiments of the present invention are simply for facilitating the understanding of the present invention and are not in any way to be construed as limiting the present invention. The present invention may variously be changed or altered without departing from its spirit and encompass equivalents thereof. The LED driving circuit 20 according to an embodiment of the present invention drives the dot matrix LED 100 made up of common LEDs.

However, the LED driving circuit 20 according to an embodiment of the present invention may drive a display in which light-emitting elements such as organic EL (Electroluminescence) elements are arranged in a matrix manner. Even in such case, the LED driving circuit 20 can suppress a time lag when the brightness of the plurality of organic EL elements is changed, as in the case of the dot matrix LED 100. Also, the LED driving circuit 20 according to an embodiment of the present invention may drive an LED of seven-segment display, for example.

The mask signal generation circuit 83 according to an embodiment of the present invention changes the mask signal MA to the H level on the basis of the timing signal T4, but this is not limitative. For example, rising of any of the PWM signals Vp0 to Vp7 to the H level is detected, and in synchronization with the rising, the mask signal MA can be changed to the H level.

Also, though the period of the clock signal CLK2 generated by the clock generation circuit 80 according to an embodiment of the present invention is a predetermined period, it may be changed on the basis of the setting data, for example. In such case, a speed at which the predetermined display is faded in or faded out can be changed on the basis of the setting data.

What is claimed is:

1. A light-emitting element driving circuit comprising:

a PWM signal output circuit configured to output a plurality of PWM signals each having one logic level whose duty ratio corresponds to gradation data and each corresponding to each of a plurality of light-emitting elements, on the basis of the gradation data indicating brightness of each of the plurality of light-emitting elements;

a driving signal output circuit configured to change the duty ratio of each of the plurality of inputted PWM signals to output the plurality of changed PWM signals as a plurality of driving signals, on the basis of instruction data for changing the brightness of the plurality of light-emitting elements; and a driving circuit configured to drive the plurality of light-emitting elements on the basis of a duty ratio of each of the plurality of driving, wherein the driving signal output circuit includes:

an output circuit configured to output an output signal having the same period as that of each of the plurality of PWM signals and having one logic level whose duty ratio is changed on the basis of the instruction data; and a driving signal generation circuit configured to change the duty ratio of each of the plurality of PWM signals on the basis of a logic level of the output signal to generate the plurality of driving signals.

2. The light-emitting element driving circuit according to claim 1, wherein the output circuit includes:

a counter configured to start counting on the basis of a clock signal according to the instruction data; and an output signal generation circuit configured to generate the output signal having the same period and having one logic level whose duty ratio corresponds to a count value of the counter, the output signal reaching the one logic level at timing when each of the plurality of PWM signals reaches the one logic level, and wherein the driving signal generation circuit generates the plurality of driving signals according to an operation result of a logical multiplication of a logic level of the plurality of PWM signals and the logic level of the output signal.

3. The light-emitting element driving circuit according to claim 2, wherein the driving circuit drives the light-emitting elements so that brightness of the plurality of light-emitting elements is increased with an increase of the duty ratio of the one logic level of each of the plurality of driving signals, and wherein the counter changes the count value on the basis of the clock signal so that the duty ratio of the one logic level of each of the plurality of driving signals is increased, when data for increasing brightness of the plurality of light-emitting elements is inputted as the instruction data; and changes the count value on the basis of the clock signal so that the duty ratio of the one logic level of each of the plurality of driving signals is decreased, when data for decreasing brightness of the plurality of light-emitting elements is inputted as the instruction data.

* * * * *